US008434918B2

(12) United States Patent
Lee et al.

(10) Patent No.: US 8,434,918 B2
(45) Date of Patent: May 7, 2013

(54) LIGHTING APPARATUS USING LIGHT EMITTING DEVICE PACKAGE

(75) Inventors: Min Sang Lee, Gyunggi-do (KR); Joo Sung Lee, Gyunggi-do (KR); Kyung Seob Oh, Incheon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 660 days.

(21) Appl. No.: 12/268,066

(22) Filed: Nov. 10, 2008

(65) Prior Publication Data

US 2010/0002429 A1 Jan. 7, 2010

(30) Foreign Application Priority Data

Jul. 2, 2008 (KR) ..... 10-2008-0063962

(51) Int. Cl.
*F21S 8/00* (2006.01)
*F21S 13/10* (2006.01)
*E01F 9/00* (2006.01)

(52) U.S. Cl.
USPC ..... 362/431; 362/153; 362/153.1

(58) Field of Classification Search ..... 362/431, 362/153, 153.1
See application file for complete search history.

(56) References Cited

U.S. PATENT DOCUMENTS

| | | | | |
|---|---|---|---|---|
| 6,211,626 | B1 | 4/2001 | Lys et al. | |
| 6,536,923 | B1 * | 3/2003 | Merz | 362/327 |
| 6,561,690 | B2 * | 5/2003 | Balestriero et al. | 362/555 |
| 6,896,381 | B2 * | 5/2005 | Benitez et al. | 359/858 |
| 7,226,185 | B2 * | 6/2007 | Dolgin et al. | 362/239 |
| 7,631,985 | B1 * | 12/2009 | Knoble et al. | 362/225 |
| 7,712,926 | B2 * | 5/2010 | Matheson | 362/294 |
| 7,810,968 | B1 * | 10/2010 | Walker et al. | 362/431 |
| 7,866,847 | B2 * | 1/2011 | Zheng | 362/249.03 |
| 2006/0285311 | A1 * | 12/2006 | Chang et al. | 362/97 |
| 2007/0285920 | A1 * | 12/2007 | Seabrook | 362/240 |
| 2008/0030974 | A1 * | 2/2008 | Abu-Ageel | 362/19 |
| 2008/0278941 | A1 * | 11/2008 | Logan et al. | 362/234 |
| 2009/0129230 | A1 * | 5/2009 | Grotsch | 369/100 |
| 2009/0135605 | A1 * | 5/2009 | Xu et al. | 362/304 |
| 2009/0323351 | A1 * | 12/2009 | Chen et al. | 362/310 |

FOREIGN PATENT DOCUMENTS

| | | | |
|---|---|---|---|
| JP | 2002-231023 | | 8/2002 |
| KR | 10-2006-0001909 | A | 1/2006 |
| KR | 10-2006-0004569 | A | 1/2006 |
| KR | 10-0643467 | B1 | 10/2006 |
| KR | 10-0808266 | B1 | 2/2008 |

OTHER PUBLICATIONS

Korean Office Action issued in Korean Patent Application No. 10-2008-0063962, mailed May 12, 2009.
Korean Office Action issued in Korean Patent Application No. KR 10-2008-0063962 dated Jan. 30, 2009.

* cited by examiner

*Primary Examiner* — David J Makiya
(74) *Attorney, Agent, or Firm* — McDermott Will & Emery LLP

(57) ABSTRACT

A lighting apparatus using a light emitting diode (LED) package is disclosed. The lighting apparatus includes a lighting unit and a power unit. The lighting unit includes a plurality of light sources each including a light emitting diode (LED) package, and a lens element having a groove for receiving the LED package and a quadrangular plane for outputting light emitted from the LED package. The power unit is electrically connected with the lighting unit and supplies power for driving the lighting unit.

11 Claims, 6 Drawing Sheets

LIGHTING APPARATUS USING LIGHT EMITTING DEVICE PACKAGE

CROSS-REFERENCE TO RELATED APPLICATIONS

This application claims the priority of Korean Patent Application No. 2008-63962 filed on Jul. 2, 2008, in the Korean Intellectual Property Office, the disclosure of which is incorporated herein by reference.

BACKGROUND OF THE INVENTION

1. Field of the Invention

The present invention relates to a lighting apparatus using a light emitting device (LED) package, and more particularly, to a lighting apparatus using an LED package, which can increase the quantity of light being emitted.

2. Description of the Related Art

In general, a lighting apparatus is used for lighting facilities such as street lamps installed along a road for street lighting or road safety. In the lighting apparatus, a lamp employing a related art mercury, fluorescent or sodium lamp as a light source is mounted on a lighting mechanism to emit light for illuminate a zone around the lighting apparatus with a predetermined intensity.

Recently, a light emitting diode (LED) having low power consumption and a long lifespan is increasingly used as a light source of a lighting apparatus in order to enhance the intensity of light and reduce power consumption. However, the lighting apparatus employing the LED has limitations in light distribution because light emitted from the lighting apparatus has a tendency to travel straight. Specifically, when light is emitted in a vertical direction, a large portion of the light reaches the ground, but the quantity of light being emitted in a horizontal direction undesirably decreases. This reduces installation intervals when lighting facilities such as street lamps are installed, and thus a larger number of lighting facilities must be installed within an equal distance.

Also, when the lighting apparatus is used in a street lamp, light emitted from the LED of the lighting apparatus to travel straight is blinding light that causes inconvenience to pedestrians.

In the case of a general lighting apparatus, a lighting unit for light emission and a power unit for power supply are installed at separate locations. For example, a street lamp has a power unit at a lower end portion of a lamp post that supports a lighting unit, i.e., at a portion near the ground. For this reason, if floods occur, the power unit is submerged because of its location and thus must be replaced thereafter. Also, since it is easy for the pedestrians to access the power unit, accidents caused by electricity may occur.

SUMMARY OF THE INVENTION

An aspect of the present invention provides a lighting apparatus capable of increasing the overall light intensity and the amount of illumination light emitted in a horizontal direction by forming a lens element having a light output surface with a quadrangular shape on a light emitting device (LED) package.

An aspect of the present invention also provides a lighting apparatus capable of increasing an optical angle by moving a light source including a lens element and an LED package.

An aspect of the present invention also provides a lighting apparatus capable of suppressing blinding light by surface-treating a light output surface of a lens element for light output from an LED package to the outside.

An aspect of the present invention also provides a lighting apparatus capable of ensuring safety by placing a power unit and a light source including a lens element and an LED package within a body of the lighting apparatus.

According to an aspect of the present invention, there is provided a lighting apparatus including: a lighting unit including a plurality of light sources, each including: a light emitting diode (LED) package; and a lens element having a groove for receiving the LED package and a quadrangular plane for outputting light emitted from the LED package; and a power unit electrically connected with the lighting unit and supplying power for driving the lighting unit.

The lighting apparatus further may further include: a body having a top surface, a side surface, a bottom surface forming an inner space for receiving the lighting unit and the power unit. The body may include a plurality of curved paths in a bottom portion thereof, and the plurality of curved paths may be positioned at locations corresponding to the plurality of light sources, respectively.

Each of the plurality of light sources may further includes: a circuit board placed under the LED package and connected with the LED package; a heat release substrate bonded on a bottom of the circuit board to release heat; and a rotary shaft having one end connected with a bottom central portion of the heat release substrate, and the other end located in the curved path and moving along the curved path to rotate the heat release substrate. The plurality of rotary shafts may vary in length according to the locations of the plurality of light sources.

The heat release substrate may include at least one material selected from the group consisting of aluminum, silver, copper and an alloy thereof. Alternatively, the heat release substrate may include an insulating substrate plated with at least one material selected from the group consisting of aluminum, silver, copper and platinum.

The power unit may include: a signal receiver receiving an ON/OFF signal; and a power controller controlling power supply to the lighting unit in response to the ON/OFF signal from the signal receiver.

The LED package may include: an LED; a package body having a cavity for receiving the LED at an upper portion thereof; a first electrode and a second body inserted in the package body and connected with the LED through wires; and an LED lens unit positioned on the cavity of the package body, having a convex upper portion and including a fluorescent material.

The groove of the lens element may have a shape curved toward the quadrangular plane. The quadrangular plane of the lens element may be surface-treated by glue coating or a sand treatment. The lens element may include an acrylic resin.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
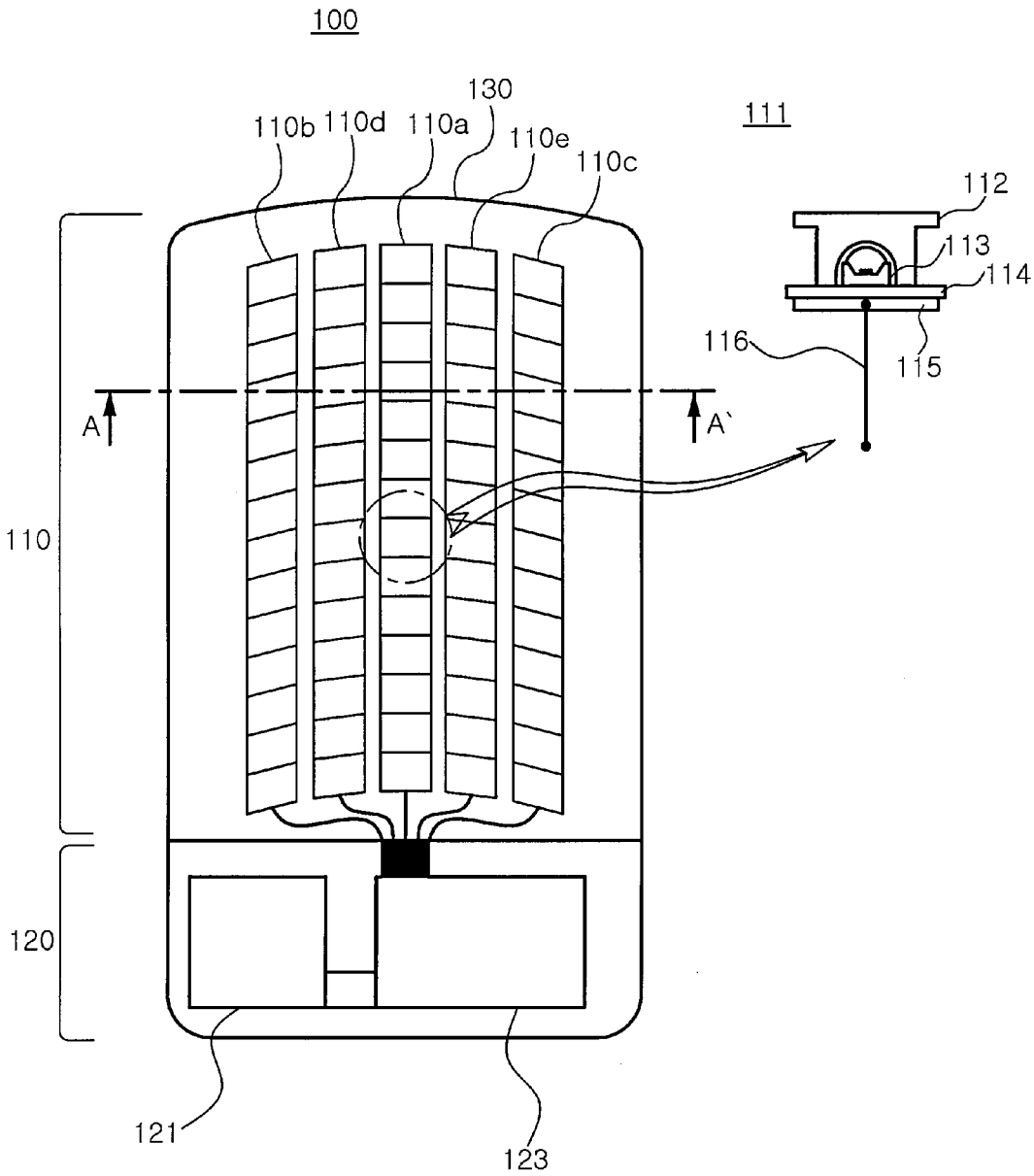
FIG. 1 illustrates a lighting apparatus according to an exemplary embodiment of the present invention.

FIG. 1 is a view illustrating a lighting apparatus according to an exemplary embodiment of the present invention. Referring to FIG. 1, a lighting apparatus 100 according to the current embodiment of the present invention includes a lighting unit 110, a power unit 120, and a body 130.

The body 130 includes a top surface, a side surface and a bottom surface, which define an internal space of the body 130. The lighting unit 110 and the power unit 120 are placed on the inside of the internal space. A plurality of curved paths (not shown) are disposed at the bottom surface of the body 130.

The lighting unit 110 includes a plurality of light sources 111 for light output. Referring to an enlarged view of the light source 111 in FIG. 1, each light source 111 includes a lens element 112, a light emitting diode (LED) package 113, a circuit board 114, a heat-release substrate 115 and a rotary shaft 116.

Figure 2:
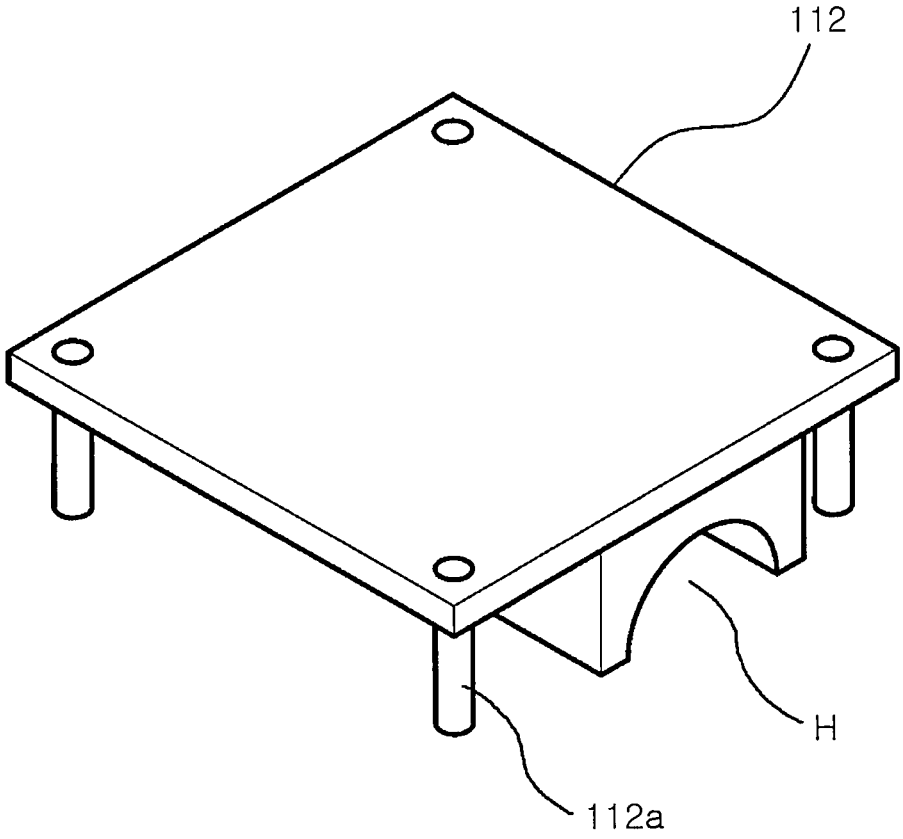
FIG. 2 is a perspective view of a lens element according to an exemplary embodiment of the present invention.

The lens element 112 has a groove for receiving the LED package 113, and a quadrangular plane for outputting light emitted from the LED package to the outside at a surface facing the groove. The lens element 112 will now be described in more detailed with reference to FIG. 2. Referring to FIG. 2, the lens element 112 has a groove H in which the LED package 113 can be mounted. In this case, the groove H has a convex shape so that light emitted from the LED package 113 can be more efficiently output. That is, the groove H increases the amount of light being extracted.

The quadrangular plane of the lens element 112 is disposed at a surface facing the groove H to output light emitted from the LED package 113 to the outside. In this case, light can be output through an entire surface of the quadrangular plane. Specifically, the quadrangular plane extracts light through its entire surface, i.e., not just through its portion corresponding to the groove H in which the LED package 113 is placed but also through its edge where the LED package 113 is not placed. Thus, the light extracted through the quadrangular plane widely spread in both vertical and horizontal directions, thereby increasing an illuminated area. The quadrangular plane of the lens element 112 is surface-treated by glue-coating or sand processing so that light emitted from the LED package 113 decreases in the straight-traveling characteristic while passing through the lens element 112. This can prevent a dazzling phenomenon. The lens element 112 includes a support 112*a* disposed at a corner of an opposite surface to the quadrangular plane, which is the light output plane.

Each light source 111 includes the circuit board 114 placed under the LED package 113 and connected with the LED package 113. In this case, an electrode (not shown) of the LED package 113 is bonded with the circuit board 114 for electrical connection therebetween.

The light source 111 includes the heat release substrate 115 bonded with the bottom of the circuit board 114 to release heat. The heat release substrate 115 may contain at least one of aluminum, copper and an alloy thereof as a heat-conductive material. Alternatively, for the light weight, the heat release substrate 115 may include an insulating substrate such as high heat-resistant plastic plated with at least one of aluminum, copper and platinum. By using the heat-conductive material or the metal-plated insulating substrate for the heat release substrate 115, a heat release property can be improved without using a separate heat release device. For example, about 36° C. was measured at a surface of the lighting apparatus 100 including the heat release substrate 115 of a heat-conductive material. As mentioned above, the heat release characteristic of the lighting apparatus 100 can be improved by using the heat-conductive material or the metal-plated insulating substrate.

The light source 111 includes the rotary shaft 116 rotating the heat release substrate 115 and changing a location of the light source 111. Specifically, the rotary shaft 116 has one end fixed to a lower central portion of the heat release substrate 115, and the other end connected to a curved path formed at the bottom surface of the body 130. The other end of the rotary shaft 116 moves along the curved path of the body 130. As the other end of the rotary shaft 116 moves, the heat release substrate 155 fixedly connected with the one end thereof is moved. Also, the movement of the heat release substrate 115 integrally moves the lens element 112, the LED package 113 and the circuit board 114 bonded on the heat release substrate 115. That is, the movement of the rotary shaft 116 moves the light source 111. An angle at which light is output can be changed by changing the location of the light source 111 through the configuration of the rotary shaft 116.

The power unit 120 is electrically connected to the lighting unit 110 and supplies power for driving the lighting unit 110. To this end, the power unit 120 includes a signal receiver 121 and a power controller 123.

The signal receiver 121 receives an ON/OFF signal. The ON/OFF signal is an operation signal for turning on/off light output of the lighting unit 110. Also, the signal receiver 121 may receive the ON/OFF signal through a variety of methods. For example, the signal receiver 121 may receive the ON/OFF signal through a method of receiving an infrared signal or a radio frequency (RF) signal.

For example, in the method of receiving an infrared signal, if an operator presses an ON/OFF button on a remote controller (not sown) facing the lighting apparatus 100, then the signal receiver 121 may receive an infrared ON/Of f signal.

As another example, in the method of receiving an RF signal, if a radio frequency (RF) signal is sent from the outside, the RF ON/OFF signal may be received by the signal receiver 121 via an antenna (not shown) installed at the lighting apparatus 100.

After the signal receiver 12 receives an ON/OFF signal through one of those methods, it transmits the corresponding signal to the power controller 123.

Besides the aforementioned method, the signal receiver 121 may be replaced with a mechanical switch (not shown) for ON/Of f control. That is, the current may be applied or blocked according to the ON/OFF control of the mechanical switch, thereby operating the power controller 123.

The power controller 123 controls power supply to the lighting unit 110 according to the ON/OFF signal transmitted from the signal receiver 121. Specifically, the power controller 123 supplies power to the lighting unit 110 when an ON signal is transmitted, and blocks power when an OFF signal is transmitted. As described above, as the lighting unit 110 and the power unit 120 are placed within the body 130 of the lighting apparatus 100, damage to the power unit 120 can be prevented, and safety of pedestrians can be ensured.

Figure 3A:
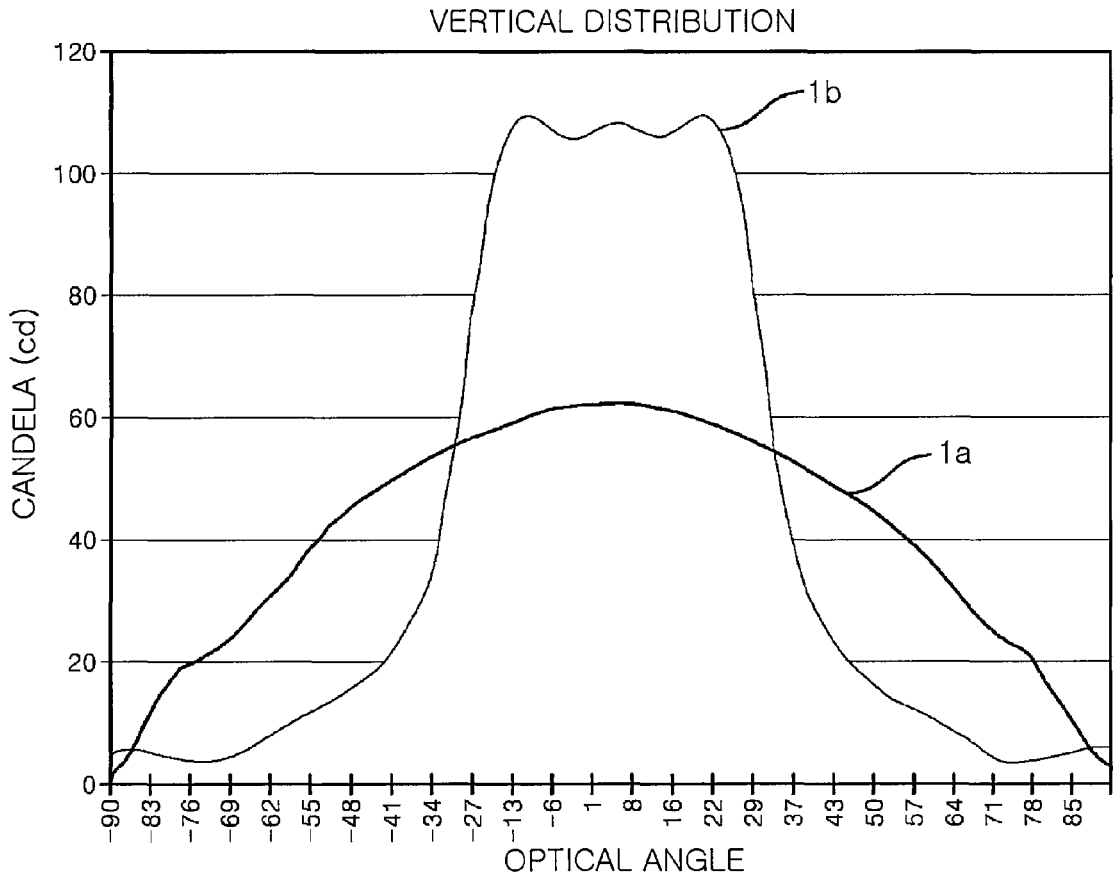
FIGS. 3A and 3B are graphs showing a candela-angle relation of a light source according to an embodiment of the present invention and a comparison example.
Figure 3B:
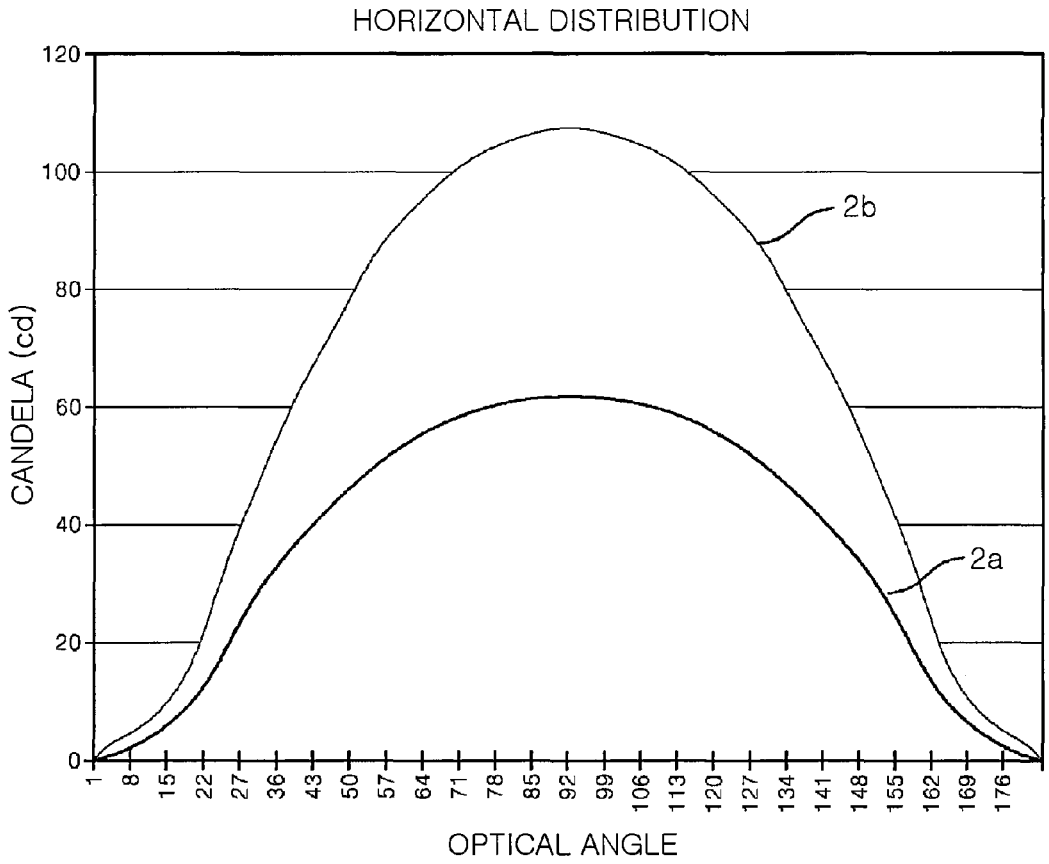

FIGS. 3A and 3B are graphs showing a candela-angle relation of a light source according to an embodiment of the present invention and a comparison example. Specifically, FIGS. 3A and 3B show a candela-angle relation of light with respect to vertical and horizontal directions of light being output through the light source 111 illustrated in FIG. 1, and a candela-angle relation of the comparison example.

The lighting apparatus 100 illustrated in FIG. 1 includes a plurality of light sources 111, and light is output through each of the light sources 111. In this case, the light source 111 has a structure in which light emitted from the LED package 113 is output through the quadrangular plane of the lens element 112. In contrast, a lighting apparatus of the comparison example does not include a lens element, and light emitted from a plurality of LED packages is output directly.

Referring to FIG. 3A, a first graph 1*a* according to the comparison example represents a result of measuring light emitted from an LED package in a vertical direction. It can be seen from the first graph 1*a* that although it has a wide optical angle, the maximum candela is just about 60 cd. In comparison, a second graph 2*b* according to the embodiment of the present invention represents a result of measuring light output from the quadrangle plane of the lens element 112 in a vertical direction. It can be seen from the second graph 1*b* that the maximum candela is about 110 cd while it has a wide optical angle. Thus, it can be seen that a higher candela value can be obtained when the lens element having light output surface with a quadrangular plane is used. Here, the optical angle refers to the inside angle of a cone shape of light being emitted from the lighting apparatus.

Referring to FIG. 3B, a wide optical angle is obtained, the maximum candela is just about 60 cd in the case of a first graph 2*a* of the comparison example representing a result of measuring light emitted from an LED package in a horizontal direction. In comparison, a second graph 2*b* according to the embodiment of the present invention represents a result of measuring light output from the quadrangular plane of the lens element 112 in a horizontal direction. It can be seen from the second graph 2*b* that the maximum candela is about 110 cd while it has a wide optical angle. Comparing the second graph 2*b* with the first graph 2*a*, the high candela is obtained over the entire optical angle area according to the embodiment of the present invention, and thus it can be seen that light is emitted over a wider area and the amount of illumination light is increased.

Figure 4:
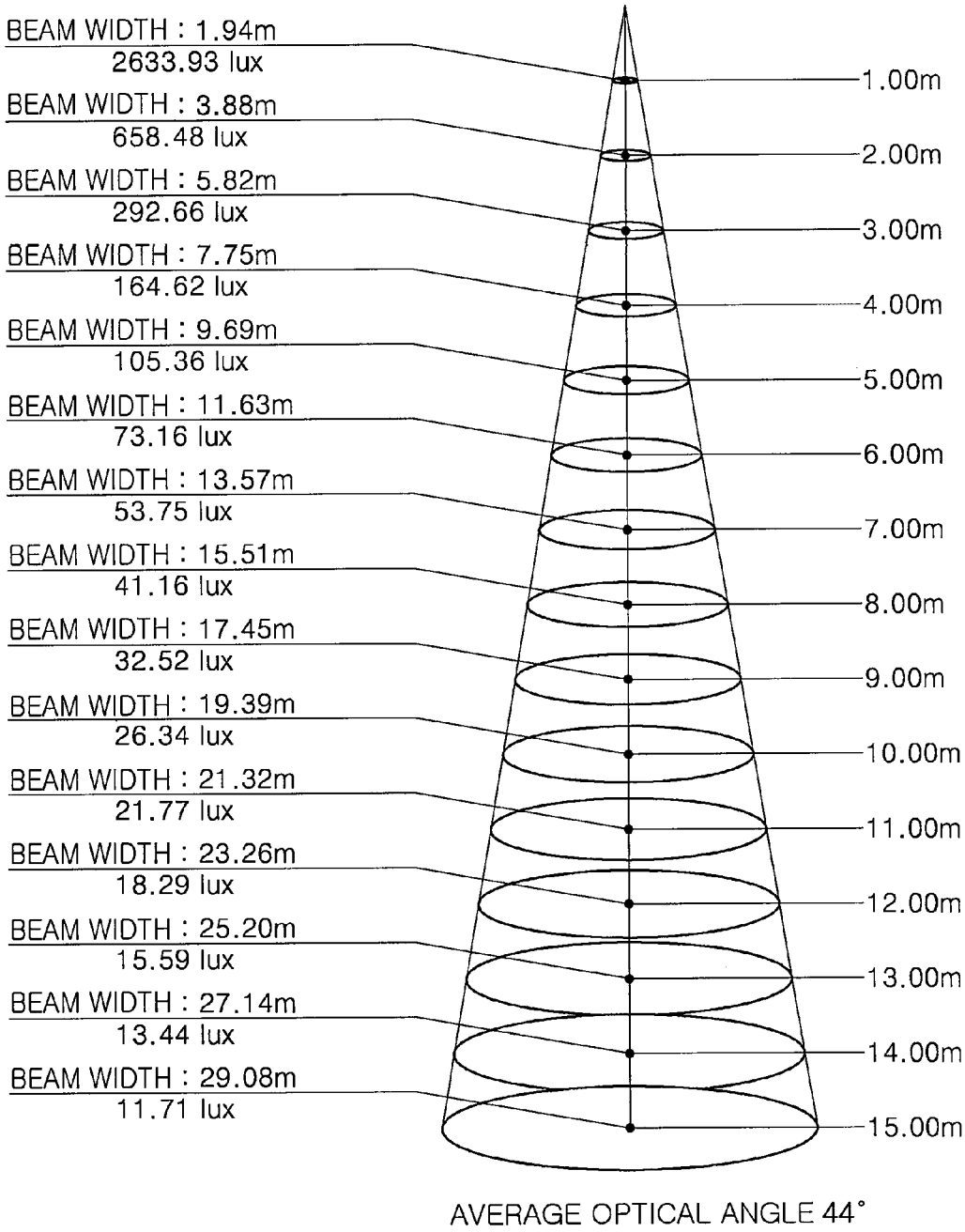
FIG. 4 is a diagram illustrating a characteristic of light emitted from the lighting apparatus of FIG. 1.

FIG. 4 is a diagram showing characteristics of light emitted from the lighting apparatus of FIG. 1. Specifically, FIG. 4 is a diagram illustrating a result of measuring a beam width and illuminance of light emitted from the lighting apparatus 100 of FIG. 1 installed spaced apart from the ground by about 15 m.

Referring to FIG. 4, light from the lighting apparatus 100 is emitted in the form of a three-dimensional cone shape. The light has a beam width and illuminance varying with how far light is emitted (hereinafter, this will now be referred to as an emission distance of light), and has an average optical angle of 44°. The diagram of FIG. 4 shows a result of measuring the beam width and illuminance of light at every one meter interval of the emission distance of light.

Referring to FIG. 4, light has a beam width of 1.94 m and central illuminance of 2633.93 lux at a point which is one meter away from the lighting apparatus 100 in a vertical direction. The light has a beam width of 9.69 m and central illuminance of 105.36 lux at a point which is five meter away from the lighting apparatus 100 in a vertical direction.

The light has a beam width of 19.39 m and central illuminance of 26.34 lux at a point ten meter away from the lighting apparatus 100 in a vertical direction. Also, the light has a beam width of 29.08 m and central illuminance of 11.71 lux at a point where the light emitted from the lighting apparatus 100 reaches the ground, i.e., at a point fifteen meter away from the lighting apparatus 100 in a vertical direction. The result of measuring the beam width and illuminance of light at every one meter interval from the lighting apparatus 100 teaches that as it is farther away from the lighting apparatus 100, the beam width of the emitted light increases and the illuminance decreases.

Figure 5:
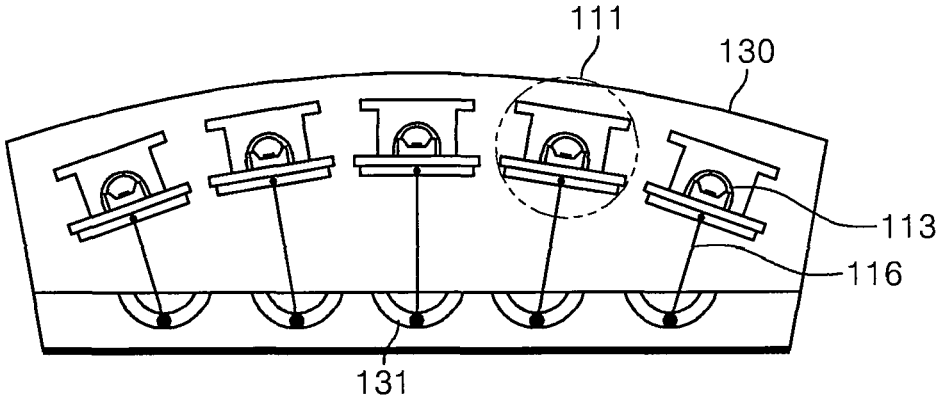
FIG. 5 is a cross-sectional view taken along line A-A' of the lighting apparatus of FIG. 1.

FIG. 5 is a cross-sectional view taken along line A-A' of the lighting apparatus of FIG. 1. Referring to FIG. 5, in the lighting apparatus 100, the plurality of light sources 111 are connected to the bottom surface of the body 130. Specifically, curved paths 131 are formed in a bottom portion of the body 130, respectively corresponding to the plurality of light sources 111. The rotary shaft 116 of each of the light sources 111 can rotate the heat release substrate 115 connected with one end of the rotary shaft 116 as the other end of the rotary shaft 116 connected to the corresponding curved path 131 moves along the curved path 131. Also, the rotation of the heat release substrate 115 can change an angle of the corresponding light source 115. After the plurality of light sources 111 are aligned at desired angles by respectively moving the rotary shafts 116 along the curved paths 131, the rotary shafts 116 are fixed by fixing pins (not shown) to maintain the locations of the plurality of light sources 111.

By changing the angles of the light sources, an illumination area of light being emitted from the lighting apparatus 100 can be increased. Specifically, referring to FIG. 1, the lighting unit 110 of the lighting apparatus 100 includes light sources disposed along first to fifth lines 110*a* to 110*e*. The first line 110*a* is placed at the center in the lighting unit 110. Respective rotary shafts of light sources disposed along the first line 110*a* are moved perpendicularly to a bottom surface of the lighting unit 110 such that the corresponding light sources face the front side.

The second line 110*b* and the third line 110*c* are placed at both sides of the lighting unit 110. The fourth line 110*d* is placed between the first line 110*a* and the second line 110*b*, and the fifth line 110*e* is placed between the first line 110*a* and the third line 110*c*. Respective rotary shafts of light sources disposed in the second and fourth lines 110*b* and 110*d* are moved such that the corresponding light sources face the left side with reference to the first line 110. At this time, the rotary shafts may be moved to place the light sources of the second line 110*b* nearer to a bottom surface of the lighting apparatus 100 than the light sources of the fourth line 110*d*.

Respective rotary shafts of light sources of the third lines 110*c* and the fifth line 110*e* are moved such that the corresponding light sources face the right side with reference to the first line 110. At this time, the rotary shafts may be moved to place the light sources of the third line 110*c* nearer to a bottom surface of the lighting apparatus 100 than the light sources of the fifth line 110*e*.

The light sources disposed only along the first to fifth lines 110*a* to 110*e* are illustrated and described in the above description. However, the present invention is not limited thereto, and the number of lines of the lighting unit 110 may be varied according to the size of the lighting apparatus 110 and the size of a light source.

By changing the angles of the light sources by moving the respective rotary shafts 116 thereof, the light can be output with a wider optical angle. To this end, the respective rotary shafts 116 of the light sources may have different lengths. An illumination area of light can be increased by controlling the angles of the plurality of light sources 111 using the respective rotary shafts 116. Also, as the illumination area of light is increased, street lamps employing the lighting apparatus 100 can be installed at a longer interval. Accordingly, as compared to the related art, the number of street lamps installed within the same distance can be decreased.

Figure 6:
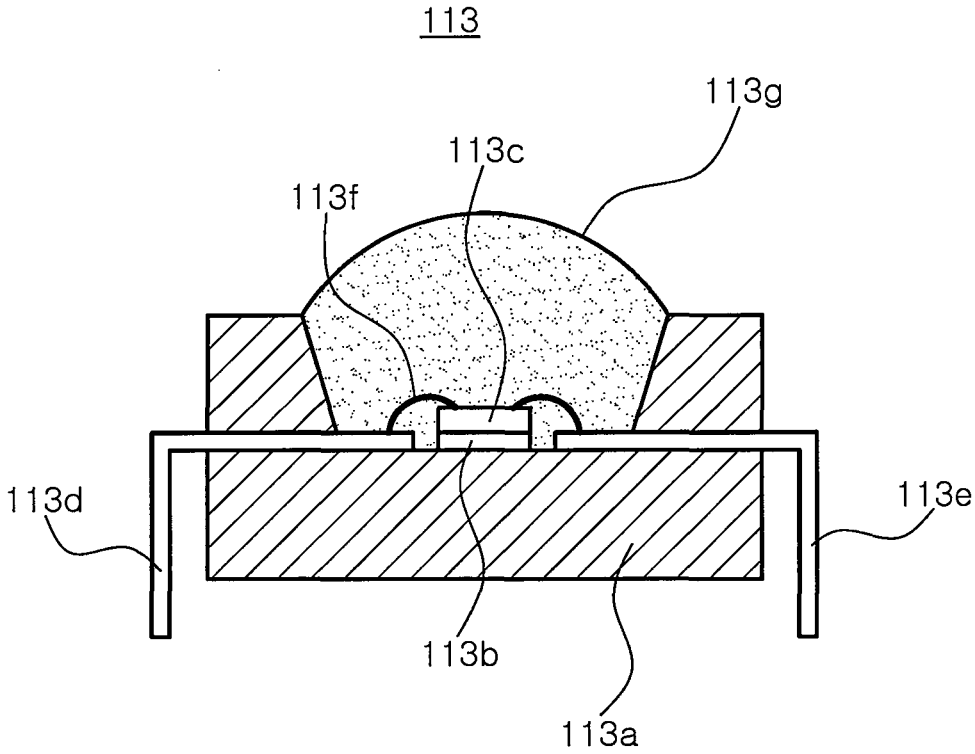
FIG. 6 illustrates a light emitting diode (LED) package according to an exemplary embodiment of the present invention.

FIG. 6 is a view illustrating an LED package according to an exemplary embodiment of the present invention. Referring to FIG. 6, the LED package 113 includes a package body 113*a*, an insulating pad 113*b*, an LED 113*c*, a first electrode 113*d*, a second electrode 113*e*, a wire 113*f*, and an LED lens 113*g*.

The package body 113*a* is formed of a ceramic material, and has a cavity formed in its upper portion. In this case, the insulating pad 113*b* and the LED 113*c* are mounted on a bottom surface inside the cavity. A plating layer of a metal material is formed on an inclined side of the cavity, thereby reflecting light emitted from the LED 113*c*.

The first electrode 113*d* and the second electrode 113*e* respectively pass through both sides of the package body 113 and extend up to the inside of the cavity. In this case, the first electrode 113*d* and the second electrode 113*e* extending up to the inside of the cavity are connected with the LED 113*c* through respective wires 113*f*.

The LED lens 113*g* includes a fluorescent material and is disposed in the cavity of the package body 113*a*. The LED lens 113*g* has a convex light-extraction surface so as to facilitate extraction of light.

According to the present invention, the lens element having a light output surface, which is a quadrangular plane, is disposed on the LED package to increase the intensity of light, thereby increasing the overall intensity of light. Also, an optical angle can be increased by moving the light sources each including a lens element and an LED package.

Also, the light output surface of the lens element for light output from the LED package to the outside is surface-treated so as to suppress blinding light. In addition, since the light sources and the power unit are placed within a body of the lighting apparatus, damage to the power unit can be prevented, and safety can be ensured.

While the present invention has been shown and described in connection with the exemplary embodiments, it will be apparent to those skilled in the art that modifications and variations can be made without departing from the spirit and scope of the invention as defined by the appended claims.

What is claimed is:

1. A lighting apparatus comprising:

a lighting unit comprising a plurality of light sources, each light source comprising:

a light emitting diode (LED) package; and a lens element comprising a lens body having a groove for receiving the LED package, and a quadrangular plane formed on the lens body, the quadrangular plane outputting light emitted from the LED package, wherein:

the lens body has a smaller width than that of the quadrangular plane, and the groove has a tunnel shape curved toward the quadrangular plane; and a power unit electrically connected with the lighting unit, the power unit supplying power for driving the lighting unit, wherein:

the plurality of light sources are arranged in a plurality of light unit lines, which are parallel to each other;

the lens body includes a plurality of curved paths in a bottom portion thereof, the plurality of curved paths being positioned at locations corresponding to the plurality of light sources, respectively;

each of the plurality of light sources has a rotary shaft having one end of the rotary shaft connected to a bottom central portion of the lighting unit and the other end located in the curved path to move along the curved path to rotate the light source; and each of the light unit lines has a different beam angle by moving the rotary shafts.

2. The lighting apparatus of claim 1, further comprising:

a body having a top surface, a side surface, a bottom surface forming an inner space for receiving the lighting unit and the power unit.

3. The lighting apparatus of claim 1, wherein each of the plurality of light sources further comprises:

a circuit board placed under the LED package and connected with the LED package; and a heat release substrate bonded on a bottom of the circuit board to release heat, wherein the one end of the rotary shaft is connected with a bottom central portion of the heat release substrate.

4. The lighting apparatus of claim 3, wherein the plurality of rotary shafts vary in length according to the locations of the plurality of light sources.

5. The lighting apparatus of claim 3, wherein the heat release substrate includes at least one material selected from the group consisting of aluminum, silver, copper and an alloy thereof.

6. The lighting apparatus of claim 3, wherein the heat release substrate comprises an insulating substrate plated with at least one material selected from the group consisting of aluminum, silver, copper and platinum.

7. The lighting apparatus of claim 1, wherein the power unit comprises:

a signal receiver receiving an ON/OFF signal; and a power controller controlling power supply to the lighting unit in response to the ON/OFF signal from the signal receiver.

8. The lighting apparatus of claim 1, wherein the LED package comprises:

an LED;

a package body having a cavity for receiving the LED at an upper portion thereof;

a first electrode and a second electrode inserted in the package body and connected with the LED through wires; and an LED lens unit positioned on the cavity of the package body, having a convex upper portion and including a fluorescent material.

9. The lighting apparatus of claim 1, wherein the quadrangular plane of the lens element is surface-treated by glue coating or sand treatment.

10. The lighting apparatus of claim 1, wherein the lens element includes an acrylic resin.

11. The lighting apparatus of claim 1, wherein the plurality of light sources is arranged such that sides of adjacent quadrangular planes face each other.

* * * * *

UNITED STATES PATENT AND TRADEMARK OFFICE

CERTIFICATE OF CORRECTION

PATENT NO. : 8,434,918 B2
APPLICATION NO. : 12/268066
DATED : May 7, 2013
INVENTOR(S) : Lee et al.

It is certified that error appears in the above-identified patent and that said Letters Patent is hereby corrected as shown below:

On the Title Page, Item [73] should read:

--CENTRAL ELECTRONICS CO., LTD. NAMYANGJU-CITY (KR)--

Signed and Sealed this
Twenty-fifth Day of March, 2014

Michelle K. Lee

Michelle K. Lee
*Deputy Director of the United States Patent and Trademark Office*